US006050709A

United States Patent [19]

Hastings

[11] Patent Number: 6,050,709

[45] Date of Patent: Apr. 18, 2000

[54] LIGHT STRING MOUNTING SYSTEM

[76] Inventor: Herman Hastings, 1731 Valle Moor Dr., Bismarck, N. Dak. 58501-2579

[21] Appl. No.: 09/071,131

[22] Filed: Apr. 30, 1998

[51] Int. Cl.[7] ..... F21V 17/10

[52] U.S. Cl. ..... 362/375; 362/248; 362/249; 362/145

[58] Field of Search ..... 362/145, 151, 362/152, 248, 249, 240, 374, 375

[56] References Cited

U.S. PATENT DOCUMENTS

| | | | |
|---|---|---|---|
| 3,204,090 | 8/1965 | Kvarda, Jr. | 362/249 |
| 3,692,993 | 9/1972 | Robinson | 362/249 |
| 5,311,414 | 5/1994 | Branham, Sr. | 362/249 |
| 5,381,324 | 1/1995 | Hillstrom et al. | 362/374 |
| 5,404,279 | 4/1995 | Wood | 362/145 |
| 5,510,966 | 4/1996 | Konecny | 362/249 |
| 5,594,628 | 1/1997 | Reuter et al. | 362/249 |
| 5,816,687 | 10/1998 | Tapp | 362/374 |

*Primary Examiner*—Alan Cariaso
*Attorney, Agent, or Firm*—Michael S. Neustel

[57] ABSTRACT

A light string mounting system for retaining and protecting at least one light string during nonuse. The inventive device includes an elongated base having a U-shaped cross-section, a cover pivotally attached to an upper portion of the base, a bias spring between the cover and the base, and a pair of tracks within the base which receive a plurality of clips. The bias spring retains the cover in the closed position when the light string is not in use. When the cover is opened to expose the light string, the bias spring retains the cover in the open position. The cover and the base are coated with material which matches the color of the trim of the building structure.

15 Claims, 4 Drawing Sheets

LIGHT STRING MOUNTING SYSTEM

BACKGROUND OF THE INVENTION

1. Field of the Invention

The present invention relates generally to light string housing devices and more specifically it relates to a light string mounting system for retaining and protecting at least one light string during nonuse.

Seasonal lighting displays are commonly installed around the roof edge of a building structure, most commonly for Christmas decorations. Strings of lights having weatherproof bulbs are mounted on fasteners to extend around the edge of the building structure under the roof line. With the passing of the season, it becomes necessary to remove the light strings to prevent the appearance of the building structure from being adversely affected. Unsightly nails or other fasteners frequently remain after the light strings have been removed because it is too much work to remove the fasteners which would have to be reinstalled the next year. It is thereby desirable to provide an assembly which decoratively follows the trim line of a building structure in a permanent installation, which would protect the lights during the long period of exposure to the elements of weather when not being utilized.

2. Description of the Prior Art

There are numerous light string housing devices. For example, U.S. Pat. No. 5,510,966 to Konecny; U.S. Pat. No. 5,311,414 to Branham; U.S. Pat. No. 5,404,279 to Wood; U.S. Pat. No. 5,594,628 to Reuter et al; U.S. Pat. No. 5,707,136 to Byers; U.S. Pat. No. 5,260,859 to Lettenmayer; U.S. Pat. No. 4,521,838 to Agabekov; U.S. Pat. No. 5,161,882 to Garrett; and U.S. Pat. No. 2,648,152 to Simpson are all illustrative of such prior art.

Konecny (U.S. Pat. No. 5,510,966) discloses a fixture for mounting to a structure which protectively encloses at least one string of lights when the lights are not in use. The fixture comprises an elongated housing with an open side, a cover movably and pivotally attached to the housing for selectively enclosing the open side.

Branham (U.S. Pat. No. 5,311,414) discloses a Christmas light mounting apparatus. Branham teaches an elongate housing having a base plate, a cover plate and a V-shaped plate pivotally attached to the cover plate for providing selective viewing of Christmas tree lights.

While these devices may be suitable for the particular purpose to which they address, they are not as suitable for retaining and protecting at least one light string during nonuse. None of the prior art devices teach a means for retaining the desired position of a pivotally attached cover. Further, none of the prior art devices allow the utilization of clips for retaining a tubular light string. Also, none of the prior art devices disclose a means for aligning a pair of light strings substantially parallel to one another and the housing.

In these respects, the light string mounting system according to the present invention substantially departs from the conventional concepts and designs of the prior art, and in so doing provides an apparatus primarily developed for the purpose of retaining and protecting at least one light string during nonuse.

SUMMARY OF THE INVENTION

A primary object of the present invention is to provide a light string mounting system that will overcome the shortcomings of the prior art devices.

Another object is to provide a light string mounting system that is an inexpensive permanent seasonal lighting system which follows a trim line.

An additional object is to provide a light string mounting system that is provided in various colors which match the trim of a house.

A further object is to provide a light string mounting system that retains the pivotal cover in a desired position of either open or closed.

Another object is to provide a light string mounting system that retains at least one string of lights.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
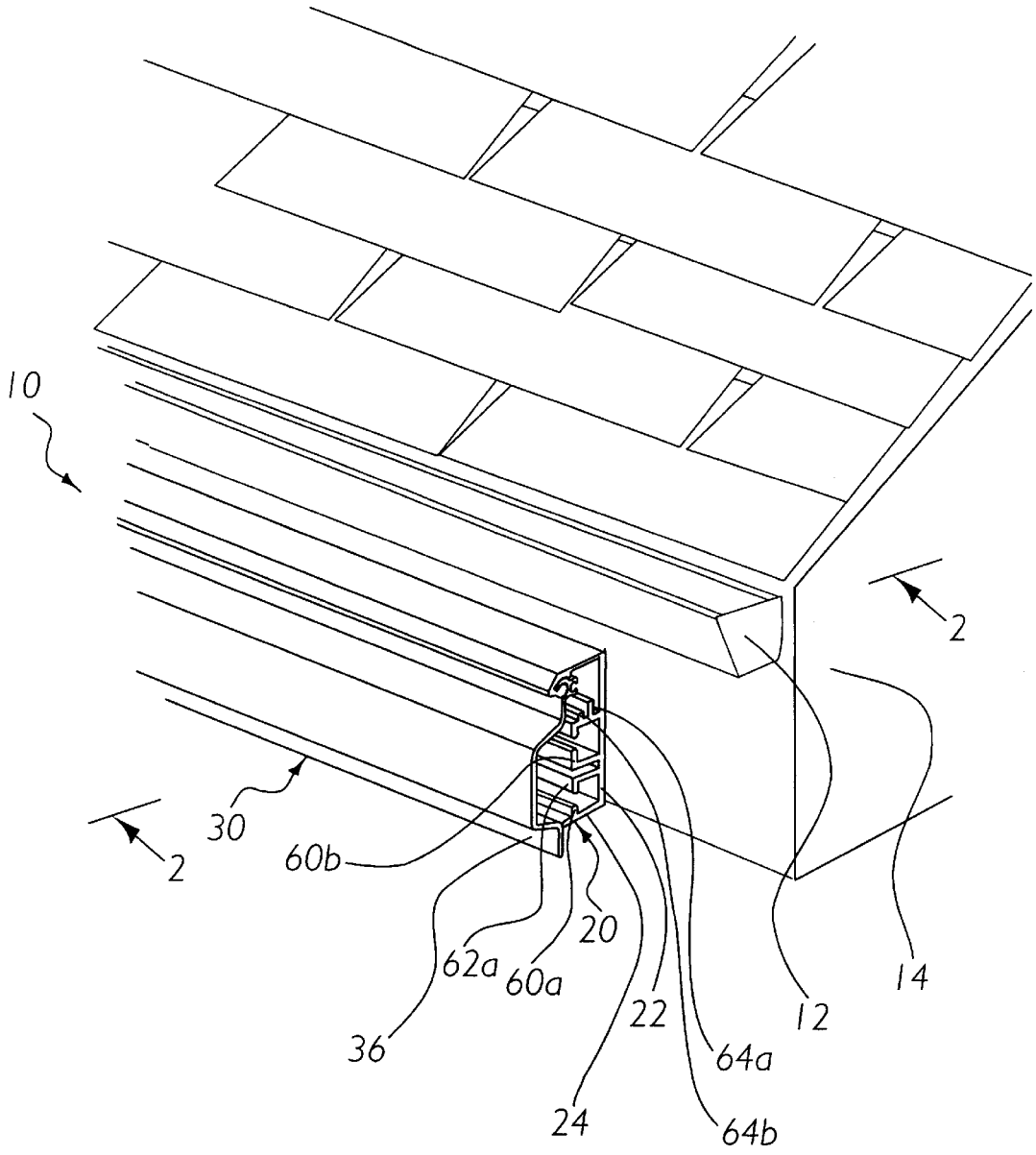
FIG. 1 is an upper perspective view of the present invention attached to the trim of a building structure.

Turning now descriptively to the drawings, in which similar reference characters denote similar elements throughout the several view, FIGS. 1 through 4 illustrate a light string mounting system 10, which comprises an elongated base 20 having a U-shaped cross-section, a cover 30 pivotally attached to an upper portion of the elongated base 20, a bias spring 40 between the cover 30 and the elongated base 20, and a pair of tracks within the base which receive a plurality of clips 70. The bias spring 40 retains the cover 30 in the closed position when the light string is not in use. When the cover 30 is opened to expose the tubular light string 18, the bias spring 40 retains the cover 30 in the open position. The exterior portion of the cover 30 and the elongated base 20 are coated with material which matches the color of the trim 14 of the building structure.

As best shown in FIG. 1 of the drawings, the elongated base 20 is attached to the trim 14 of the house by conventional fasteners such as screws, nails or bolts. The elongated base 20 is generally positioned directly beneath the rain gutter 12 or where conventional Christmas lights are generally mounted.

Figure 2:
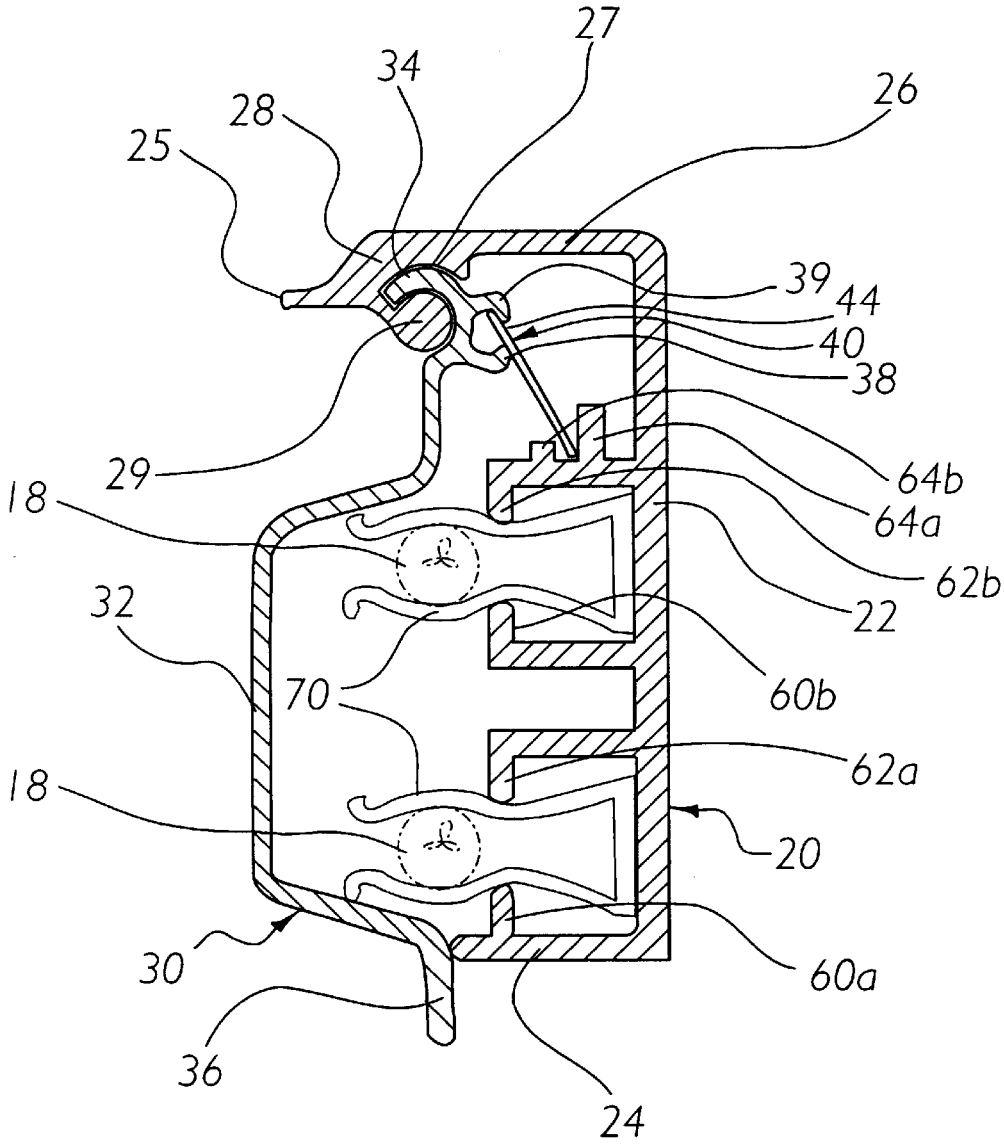
FIG. 2 is a cross sectional view along line 2—2 of FIG. 1 with the cover closed.
Figure 3:
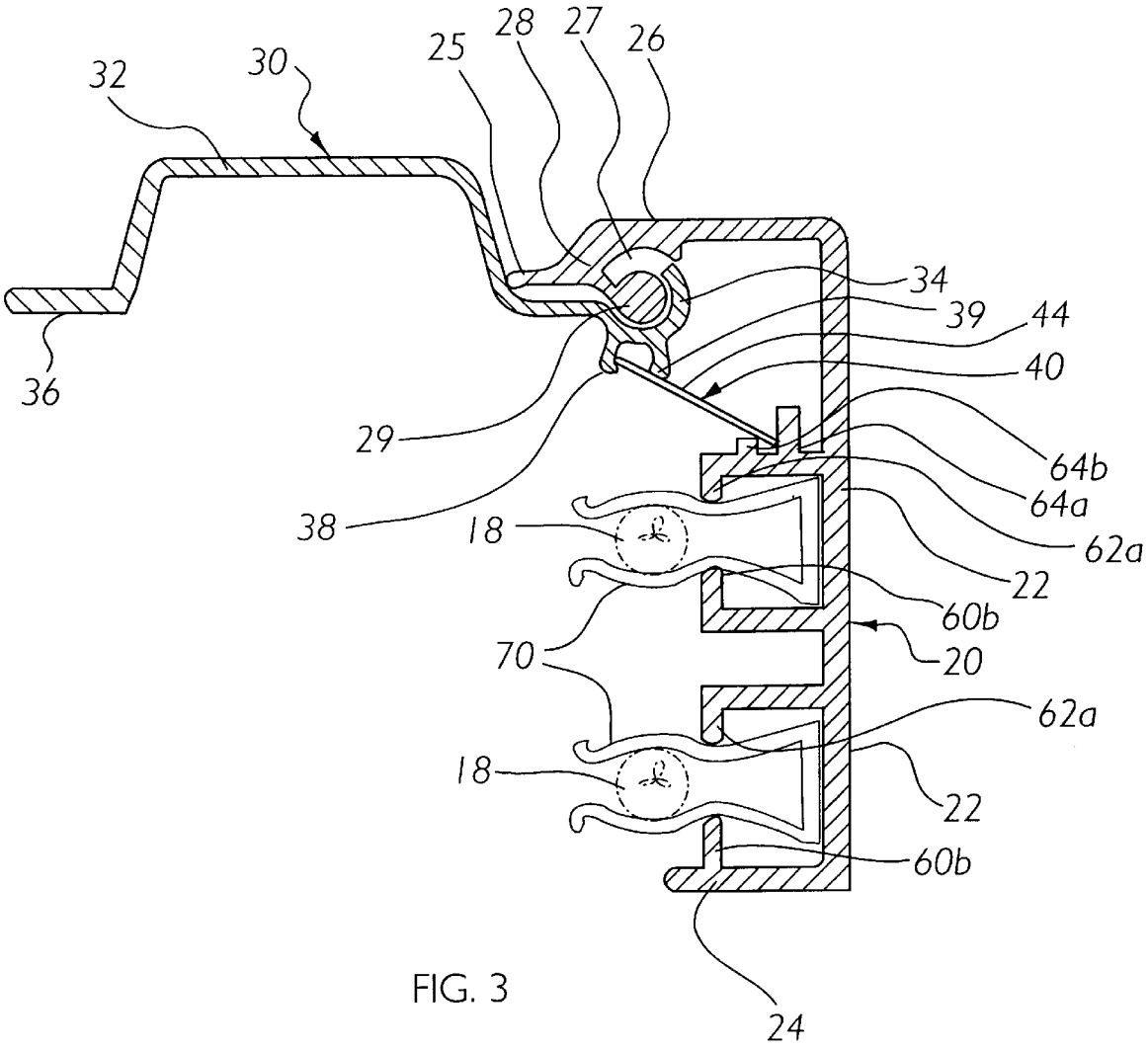
FIG. 3 is a side cut-away view with the cover opened.

As best shown in FIGS. 2 and 3 of the drawings, the elongated base 20 has a U-shaped cross-section. The elongated base 20 comprises a back plate 22, an upper lip 26 and a lower lip 24. The upper lip 26 and the lower lip 24 define a channel which receives the tubular light string 18 or other light string. The base further includes a lower track 60*a* attached to the inner portion of the lower lip 24. An upper track 62*a* is attached to the inner portion of the back plate 22 in opposition to the lower track 60*a* for slidably receiving a plurality of clips 70. The clips 70 receive the tubular light string 18 substantially parallel to the lower lip 24. The tubular light string 18 is preferably a product named DURAFLEX made by Horizon Industries. A lower track 60*b* is attached to the interior portion of the back plate 22 directly above the upper track 62*a*. An upper track 62*b* is attached to the interior portion of the back plate 22 in opposition to the lower track 60*b* for slidably receiving a plurality of clips 70. This allows a pair of tubular light strings 18 to be connected within the elongated base 20.

As shown in FIGS. 2 and 3 of the drawings, the upper lip 26 includes a hinge arm 28. At the end of the hinge arm 28 is a cylindrical member 29 which forms an arcuate channel 27 between the hinge arm 28. A stopper 25 is attached to the upper lip 26 which limits the amount of movement of the cover 30 with respect to the elongated base 20.

As shown in FIGS. 2 and 3 of the drawings, the cover 30 comprises a face plate 32 having a substantially U-shaped cross-section. The cover 30 includes a hook portion 34 which is in slidable engagement with the arcuate channel 27. The cover 30 further includes a handle portion 36 opposite of the hook portion 34 for allowing manual manipulation of the cover 30 with respect to the elongated base 20.

As best shown in FIGS. 2 and 3 of the drawings, a pair of guide ridges 64*a–b* are attached to the upper track 62*b* opposite of the lower track 60*b*. The guide ridge 64*a* is positioned between the guide ridge 64*b* and the back plate 22.

As best shown in FIGS. 2 and 3 of the drawings, a first jaw 38 and a second jaw 39 are attached to the hook portion 34 of the cover 30. The second jaw 39 is between the first jaw 38 and the handle portion 36 as best shown in FIGS. 2 and 3 of the drawings.

Figure 4:
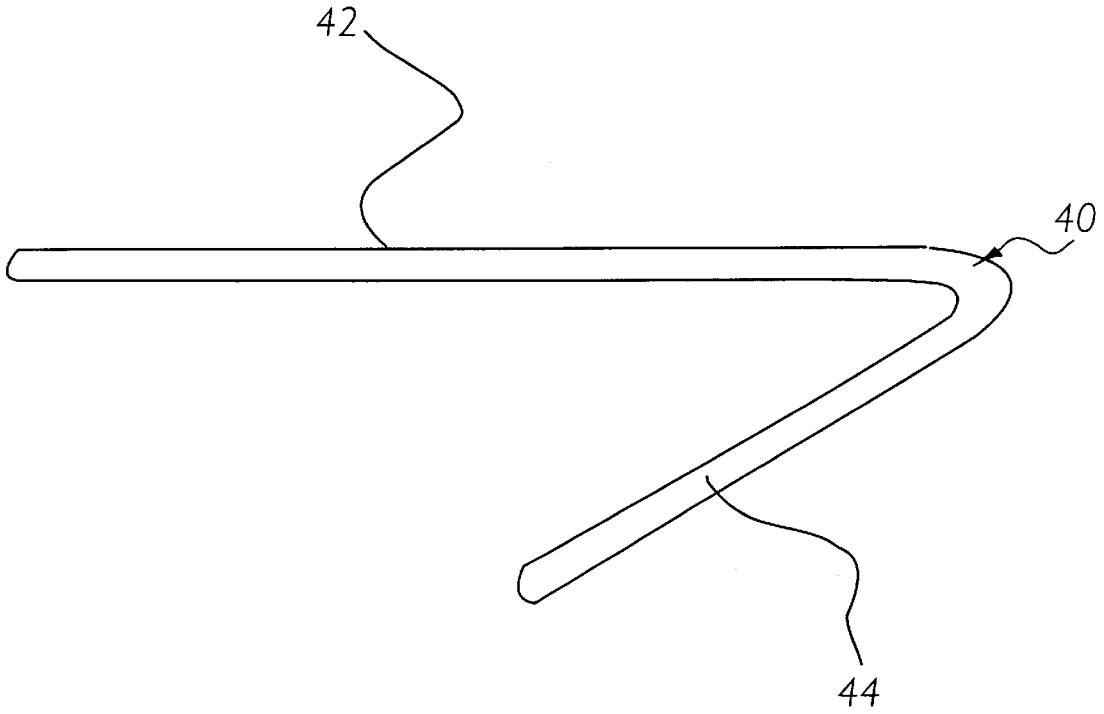
FIG. 4 is a top view of the bias spring.

The bias spring 40 has a base member 42 and an arm member 44 as best shown in FIG. 4 of the drawings. The base member 42 is preferably longer than the arm member 44. The arm member 44 is attached at an end of the base member 42 and extends at an acute angle from the base member 42. The base member 42 of the bias spring 40 is positioned within the channel created by the first jaw 38 and the second jaw 39. The arm member 44 extends from the base member 42 to engage the channel created by the guide ridges 64*a–b*. The guide ridge 64*b* is shorter than the guide ridge 64*a* to allow the arm member 44 to freely pass.

In use, the user manually manipulates the handle portion 36 of the cover 30 with their hands or an elongated object to open the cover 30. As the cover 30 pivots within the arcuate channel 27, the bias spring 40 is positioned centrally between the first jaw 38 and the second jaw 39. As the cover 30 is pivoted upwardly, the bias spring 40 becomes in engagement with the first jaw 38 thereby assisting in the pivoting of the cover 30 upwardly. After the cover 30 is fully opened, the bias spring 40 retains the cover 30 in the open position for an indefinite length of time. The user then activates the tubular light string 18 or other light string to illuminate the lights. Since the elongated base 20 is preferably constructed from extruded aluminum, the interior portion of the elongated base 20 has a reflective surface which enhances the light projecting from the tubular light string 18. After the holiday season has passed, the user desires to close the cover 30 to prevent the general public from viewing the unattractive tubular light string 18. The user manually manipulates the cover 30 by engaging the handle portion 36 thereby forcing the cover 30 downwardly until it is in engagement with the lower lip 24 of the elongated base 20. The bias spring 40 is now in engagement with the second jaw 39 thereby forcing the cover 30 to stay in the closed position which prevents movement or accidental opening of the cover 30 during high gusts of wind.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A light string mounting system comprising:

an elongated housing having an opening and a channel, wherein said channel receives at least one light string;

a cover pivotally attached to said elongated housing for selectively covering said opening;

a means for retaining said cover in either a closed position or an open position with respect to said elongated housing, wherein said means for retaining comprises at least one bias spring; and wherein said cover includes a first jaw and a second jaw adjacent a pivot axis, wherein said first jaw and second jaw define a groove which receives said bias spring.

2. The light string mounting system of claim 1, wherein cover is pivotally attached to an upper portion of said elongated housing.

3. The light string mounting system of claim 1, wherein said elongated housing includes at least one track within said channel of said elongated housing for receiving a plurality of clips, wherein said clips support said light string.

4. The light string mounting system of claim 3, wherein said bias spring is in engagement with said at least one track.

5. The light string mounting system of claim 4, wherein when said cover is in said closed position said bias spring is in engagement with said second jaw, and wherein when said cover is in said open position said bias spring is in engagement with said first jaw for retaining the desired position.

6. The light string mounting system of claim 2, wherein said elongated housing includes a stopper member attached to said upper portion for preventing overextension of said cover.

7. The light string mounting system of claim 1, wherein an exterior surface of said cover and said elongated housing includes a color coating which matches a color of trim on a building structure.

8. The light string mounting system of claim 1, wherein said channel of said elongated housing is reflective of light.

9. The light string mounting system of claim 1, wherein said elongated housing has a U-shaped cross-section.

10. A light string mounting system comprising:

an elongated housing having an opening and a channel, wherein said channel receives at least one light string;

a cover pivotally attached to said elongated housing for selectively covering said wherein said cover includes a handle portion exending from said cover opposite of said elongated housing for allowing manual manipulation of the cover opening, wherein said cover has a U-shaped cross-section;

a means for retaining said cover in either a closed position or an open position with respect to said elongated housing, wherein said means for retaining comprises at least one bias spring.

11. The light string mounting system of claim 10, wherein said cover includes a first jaw and a second jaw adjacent a pivot axis, wherein said first jaw and second jaw define a groove which receives said bias spring.

12. The light string mounting system of claim 10, wherein said cover is pivotally attached to an upper portion of said elongated housing.

13. The light string mounting system of claim 10, wherein said elongated housing includes at least one track within said channel of said elongated housing for receiving a plurality of clips, wherein said clips support said light string.

14. The light string mounting system of claim 13, wherein said bias spring is in engagement with said at least one track.

15. The light string mounting system of claim 11, wherein when said cover is in said closed position said bias spring is in engagement with said second jaw, and wherein when said cover is in said open position said bias spring is in engagement with said first jaw for retaining the desired position.

* * * * *